US007980329B2

(12) United States Patent
Spiecker et al.

(10) Patent No.: US 7,980,329 B2
(45) Date of Patent: Jul. 19, 2011

(54) SYSTEM FOR MANAGING VARIABLE DENSITY DRILLING MUD

(75) Inventors: Paul Matthew Spiecker, Manvel, TX (US); Pavlin B. Entchev, Houston, TX (US); Ramesh Gupta, Berkley Heights, NJ (US); Richard Polizzotti, Milford, NJ (US); Barbara Carstensen, Annandale, NJ (US); Dennis G. Peiffer, Annandale, NJ (US); Norman Pokutylowicz, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 12/691,783

(22) Filed: Jan. 22, 2010

(65) Prior Publication Data

US 2010/0116553 A1 May 13, 2010

Related U.S. Application Data

(63) Continuation of application No. 12/160,999, filed as application No. PCT/US2007/003691 on Feb. 13, 2007, now Pat. No. 7,677,332.

(60) Provisional application No. 60/779,679, filed on Mar. 6, 2006.

(51) Int. Cl.
*E21B 21/01* (2006.01)
*E21B 21/06* (2006.01)

(52) U.S. Cl. ..... 175/206; 175/66; 175/207

(58) Field of Classification Search ..... None
See application file for complete search history.

(56) References Cited

U.S. PATENT DOCUMENTS

| | | | |
|---|---|---|---|
| 3,174,561 | A | 3/1965 | Sterrett |
| 3,231,030 | A | 1/1966 | Blom |
| 4,216,836 | A | 8/1980 | Rayborn |
| 4,217,208 | A | 8/1980 | Wentzler |
| 4,571,296 | A | 2/1986 | Lott |
| 5,881,826 | A | 3/1999 | Brookey |
| 6,138,757 | A | 10/2000 | Latos et al. |
| 6,235,803 | B1 | 5/2001 | Weiser et al. |
| 6,415,877 | B1 | 7/2002 | Fincher et al. |
| 6,451,953 | B1 | 9/2002 | Albright |
| 6,530,437 | B2 | 3/2003 | Maurer et al. |

(Continued)

FOREIGN PATENT DOCUMENTS

WO WO 2006/007347 1/2006

OTHER PUBLICATIONS

*European Search Report* No. 113773, dated Sep. 15, 2006.

(Continued)

*Primary Examiner* — George Suchfield

(57) ABSTRACT

A method and system for drilling a wellbore is described. The system includes a wellbore with a variable density drilling mud, drilling pipe, a bottom hole assembly disposed in the wellbore and a drilling mud processing unit in fluid communication with the wellbore. The variable density drilling mud has compressible particles and drilling fluid. The bottom hole assembly is coupled to the drilling pipe, while the drilling mud processing unit is configured to separate the compressible particles from the variable density drilling mud. The compressible particles in this embodiment may include compressible hollow objects filled with pressurized gas and configured to maintain the mud weight between the fracture pressure gradient and the pore pressure gradient. In addition, the system and method may also manage the use of compressible particles having different characteristics, such as size, during the drilling operations.

7 Claims, 7 Drawing Sheets

U.S. PATENT DOCUMENTS

| | | | | |
|---|---|---|---|---|
| 6,588,501 | B1 | 7/2003 | Boyadjieff | |
| 6,610,798 | B1 | 8/2003 | Bleijenberg et al. | |
| 6,689,465 | B1 | 2/2004 | Omori et al. | |
| 6,739,408 | B2 | 5/2004 | Rowden | |
| 6,747,107 | B2 | 6/2004 | Petela et al. | |
| 6,953,097 | B2 | 10/2005 | Seyffert | |
| 7,108,066 | B2 | 9/2006 | Jamison | |
| 7,264,051 | B2 | 9/2007 | Nguyen et al. | |
| 7,334,636 | B2 | 2/2008 | Nguyen | |
| 7,361,693 | B2 | 4/2008 | Albright et al. | |
| 7,494,711 | B2 | 2/2009 | Kaufman et al. | |
| 7,677,332 | B2 * | 3/2010 | Spiecker et al. | 175/40 |
| 2002/0011338 | A1 | 1/2002 | Maurer et al. | |
| 2003/0164235 | A1 | 9/2003 | Leeson et al. | |
| 2003/0196804 | A1 | 10/2003 | Riet | |
| 2004/0033905 | A1 | 2/2004 | Shinbach et al. | |
| 2004/0089591 | A1 | 5/2004 | Marcotullio et al. | |
| 2004/0154963 | A1 | 8/2004 | Rayborn | |
| 2005/0023038 | A1 | 2/2005 | Seyffert | |
| 2005/0113262 | A1 | 5/2005 | Ravi et al. | |
| 2005/0161262 | A1 | 7/2005 | Jamison | |
| 2005/0284641 | A1 | 12/2005 | Watkins et al. | |
| 2006/0070772 | A1 | 4/2006 | deBoer | |
| 2006/0213663 | A1 | 9/2006 | Vargo, Jr. et al. | |
| 2006/0217270 | A1 | 9/2006 | Vargo, Jr. et al. | |
| 2006/0254775 | A1 | 11/2006 | Jamison | |
| 2007/0027036 | A1 * | 2/2007 | Polizzotti et al. | 507/143 |
| 2008/0300339 | A1 | 12/2008 | Wright et al. | |
| 2009/0114450 | A1 | 5/2009 | Watkins et al. | |
| 2009/0151944 | A1 | 6/2009 | Fuller et al. | |
| 2009/0163388 | A1 | 6/2009 | Reddy et al. | |

OTHER PUBLICATIONS

*International Search Report and Written Opinion*, dated Dec. 28, 2007.

* cited by examiner

SYSTEM FOR MANAGING VARIABLE DENSITY DRILLING MUD

CROSS REFERENCE TO RELATED APPLICATIONS

This application is a continuation of U.S. application Ser. No. 12/160,999, filed 30 Sep. 2008 now U.S. Pat. No. 7,677,332, which is the national stage of PCT/US2007/003691 that published as WO 2007/102971 and was filed on 13 Feb. 2007, which claims the benefit of U.S. Provisional Application No. 60/779,679, filed 6 Mar. 2006, each of which is incorporated herein by reference, in its entirety, for all purposes.

FIELD OF THE INVENTION

This invention relates generally to an apparatus and method for use in wellbores and associated with drilling operations to produce hydrocarbons. More particularly, this invention relates to a wellbore apparatus and method for managing compressible particles in a variable density drilling mud.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

The production of hydrocarbons, such as oil and gas, has been performed for numerous years. To produce these hydrocarbons, a wellbore is typically drilled in intervals with different casing strings installed to reach a subsurface formation. The casing strings are installed in the wellbore to prevent the collapse of the wellbore walls, to prevent undesired outflow of drilling mud into the formation, and/or to prevent the inflow of formation fluid into the wellbore. Because the casing strings for lower intervals pass through already installed casing strings, the casing strings are formed in a nested configuration that continue to decrease in diameter in each of the subsequent intervals of the wellbore. That is, typically casing strings in the lower intervals have smaller diameters to fit within the previously installed casing strings. Alternatively, the expandable casing strings may be utilized within the wellbore. However, the expandable casing strings are typically more expensive and increase the cost of the well.

The process of installing casing strings involves tripping/running the casing string and cementing the casing string, which is time consuming and costly. With the nested configuration, the initial casing strings have to be sufficiently large to provide a wellbore diameter that is able to be utilized for the tools and other devices. With subsurface formations being located at greater depths, the diameter of the initial casing strings are relatively large to provide a final wellbore diameter useable for the production of hydrocarbons. Large wellbores increase the cost of the drilling operations because the increased size results in increased cuttings, increased casing string size and costs, and increased volume of cement and drilling mud utilized in the wellbore.

Accordingly, various processes are utilized to reduce the diameter of casing strings installed within the wellbore. For example, some processes describe modifying the drilling mud to install fewer different casing strings within the wellbore. A drilling mud is utilized to remove cuttings and provide hydrostatic pressure to the subsurface formation to maintain drilling operations for a well. The weight or density of the drilling mud is typically maintained between the pore pressure gradient (PPG) and the fracture pressure gradient (FG) for drilling operations. However, the PPG and FG often vary along with the true vertical depth (TVD) of the well, which present problems for maintaining the weight or density of the drilling mud. If the density of the drilling mud is below the PPG, the well may kick. A kick is an influx of formation fluid into the wellbore, which has to be controlled before drilling operations may resume. Also, if the density of the drilling mud is above the FG, the drilling mud may be leaked off into the formation. The leakage may result in lost returns or large volumes of drilling mud loss, which has to be replaced for the drilling operations to resume. Accordingly, the density of the drilling mud has to be maintained within the PPG and FG to continue drilling operations that utilize the same size casing string.

Accordingly, drilling operations may utilize variable density drilling mud to maintain the density of the drilling mud within the PPG and FG for the wellbore. See Intl. Patent Application Publication No. WO 2006/007347. To reduce the number of intermediate casing strings utilized within the well, the variable density drilling mud may include various compressible particles to provide a drilling mud that operates within the PPG and FG. Because the drilling operations may be continuous, the compressible particles may have to circulate within the wellbore one or more times. As such, there is a need for a method and apparatus for managing the compressible particles that are utilized within the variable density drilling mud.

Other related material may be found in at least U.S. Pat. Nos. 3,174,561; 3,231,030; 4,099,583; 4,192,392; 5,881,826; 5,910,467; 6,156,708; 6,415,877; 6,422,326; 6,497,289; 6,530,437; 6,588,501; 6,739,408; 6,953,097; U.S. Patent Application Publication No. 2004/0089591; U.S. Patent Application Publication No. 2005/0023038; U.S. Patent Application Publication No. 2005/0113262; U.S. Patent Application Publication No. 2005/0161262; and Intl. Patent Application Publication No. WO 2006/007347.

SUMMARY

In one embodiment, a system for drilling a wellbore is described. The system includes a wellbore with a variable density drilling mud, drilling pipe, a bottom hole assembly disposed in the wellbore and a drilling mud processing unit in fluid communication with the wellbore. The variable density drilling mud has compressible particles and drilling fluid. The bottom hole assembly is coupled to the drilling pipe, while the drilling mud processing unit is configured to separate the compressible particles from the variable density drilling mud. The compressible particles in this embodiment may include compressible hollow objects filled with pressurized gas and configured to maintain the mud weight between the fracture pressure gradient and the pore pressure gradient.

The system may also include various modifications to the drilling mud processing unit. For instance, as a first embodiment, the drilling mud processing unit may include a rig shaker screen configured to receive the variable density drilling mud and cuttings from the wellbore and divert material equal to or greater than the size of the compressible particles to a shaker flow path; a cutting shaker screen coupled to the rig shaker screen and configured to divert material equal to or less than the size of the compressible particles from the shaker flow path to a cutting flow path; a hydrocyclone coupled to the cutting shaker screen and configured to receive material from the cutting flow path, separate material from the cutting flow path based on density; and provide material having a density similar to the compressible particles to a hydrocyclone flow path; and an additional shaker screen coupled to the hydrocyclone and configured to receive material from the hydrocyclone flow path and remove the compressible particles from the hydrocyclone flow path. Alternatively, material larger than compressible particles may be removed in the rig shaker screen and those equal to or smaller than compressible particles may be diverted to a shaker flow path. Then, the next separation diverts material equal to or greater than the compressible particles to a cutting flow path provided to the hydrocyclones.

As a second embodiment, the drilling mud processing unit may include a rig shaker screen that receives the variable density drilling mud and cuttings from the wellbore and removes the cuttings greater than the size of the compressible particles; and a settling tank in fluid communication with the rig shaker screen and configured to receive the remaining material from the rig shaker screen and separate compressible particles from the remaining material by density. This drilling mud processing unit may also include an additional shaker screen coupled to the settling tank and configured to remove the compressible particles from the remaining material. As a third embodiment, the drilling mud processing unit may include a rig shaker screen configured to receive the variable density drilling mud and cuttings from the wellbore and divert material less than or equal to the size of the compressible particles to a shaker flow path; a hydrocyclone coupled to the rig shaker screen and configured to receive the shaker flow path and divert material having a density similar to the density of the compressible particles to a hydrocyclone flow path; and an additional shaker screen coupled to the hydrocyclone and configured to receive the hydrocyclone flow path and remove the compressible particles from the hydrocyclone flow path. As a fourth embodiment, the drilling mud processing unit may include a rig shaker screen configured to receive the variable density drilling mud and cuttings from the wellbore and divert material equal to or less than the size of the compressible particles into a shaker flow path; a centrifuge coupled to the rig shaker screen and configured to receive the shaker flow path and divert material having a density similar to the compressible particles into a centrifuge flow path; and an additional shaker screen coupled to the centrifuge and configured to receive the centrifuge flow path and remove the compressible particles from the centrifuge flow path.

Further, the drilling mud processing unit may include different embodiments to insert the compressible particles into the drilling fluid to form the variable density drilling mud. For example, as a first embodiment, the drilling mud processing unit may include a mud pit; at least one mixer in fluid communication with the mud pit and configured to blend the compressible particles with the drilling fluid to form the variable density drilling mud; at least one monitor in fluid communication with the mud pit and configured to monitor the density of the variable density drilling mud; and a mud pump in fluid communication with the monitor and configured to provide the variable density drilling mud to the wellbore. As a second embodiment, the drilling mud processing unit may include a mud pit; at least one monitor in fluid communication with the mud pit and configured to combine the compressible particles with the drilling fluid to form the variable density drilling mud; and a mud pump in fluid communication with the at least one monitor and configured to provide the variable density drilling mud to the wellbore. As a third embodiment, the drilling mud processing unit may include a storage vessel configured to receive drilling fluid and compressible particles to form the variable density drilling mud; a compression pump in fluid communication with the storage vessel and configured to compress the compressible particles in the variable density drilling mud into the compressed state; and a mud pump in fluid communication with the compression pump via piping and configured to provide the variable density drilling mud to the wellbore. As a fourth embodiment, the drilling mud processing unit may include a compressible particles pump configured to provide the compressible particles to a primary flow path in the wellbore; and a drilling fluid pump configured to provide the drilling fluid to a secondary flow path in the wellbore, wherein the compressible particles and the drilling fluid mix in a blending section of the wellbore. As a fifth embodiment, the drilling mud processing unit may include a compressible particles pump configured to pump the compressible particles from the surface to a blending section within the wellbore through a parasite string; and a drilling fluid pump configured to pump the drilling fluid to a drill bit within the wellbore through the drill pipe, wherein the compressible particles and the drilling fluid mix in a blending section of the wellbore.

In addition, the bottom hole assembly may be configured to separate the compressible particles from the variable density drilling mud to divert the compressible particles away from a drill bit. As a first embodiment, the bottom hole assembly may include a drill bit; a separator coupled between the drill bit and the drill pipe and a separator. The separator may be configured to: receive the variable density drilling mud; separate the variable density drilling mud into a first flow path and a second flow path, wherein at least a portion of the compressible particles are within the second flow path; provide the first flow path to a first wellbore location near or through the drill bit; and divert the second flow path to a second wellbore location above the drill bit. The second flow path may be diverted into a bypass tube to the second wellbore location above the drill bit from the center of the separator or diverted through a bypass opening to the second wellbore location above the drill bit from an exterior wall of the separator. The diverting of the compressible particles may be different for different densities of the compressible particles in certain applications. Also, the compressible particles may be separated at different locations within the wellbore and at the surface.

In a second embodiment, a method associated with production of hydrocarbons is described. The method includes circulating a variable density drilling mud in a wellbore, wherein the variable density drilling mud maintains the density of a drilling mud between the pore pressure gradient (PPG) and the fracture pressure gradient (FG) for drilling operations and comprises compressible particles with a drilling fluid; and diverting at least a portion of compressible particles from the variable density drilling mud to manage the use of the compressible particles. Also, the method may include obtaining compressible particles and drilling fluid and combining the compressible particles and the drilling fluid to form a variable density drilling mud. The compressible particles in this embodiment may include compressible hollow objects filled with pressurized gas and configured to maintain the mud weight between the fracture pressure gradient and the pore pressure gradient. The method may also include separating the compressible particles from the variable density drilling mud within the wellbore at a bottom hole assembly.

The method may also include separating damaged compressible particles from undamaged compressible particles in the variable density drilling mud; and recirculating undamaged compressible particles in the variable density drilling mud. The separation of the damaged compressible particles from the undamaged compressible particles may be performed at the surface of the wellbore. Further, the separation of the damaged compressible particles from the undamaged compressible particles may include additional steps of receiving slurry from the wellbore, wherein the slurry comprises cuttings and the variable density drilling mud; separating the slurry into a first flow of material greater than the size of the compressible particles and a second flow of material less than or equal to the size of the compressible particles via screens; providing the second flow to a hydrocyclone; and separating undamaged compressible particles from the variable density drilling mud, cuttings and damaged compressible particles in the hydrocyclone. As a second alternative, the separation of the damaged compressible particles from the undamaged compressible particles may include providing slurry from the wellbore to a settling tank, wherein the slurry comprises cuttings and the variable density drilling mud; and separating the undamaged compressible particles from the settling tank. As a third alternative, the separation of the damaged compressible particles from the undamaged compressible particles may include receiving slurry from the wellbore, wherein the slurry comprises cuttings and the variable density drilling mud; separating the slurry into a first flow of material greater than the size of the compressible particles and a second flow of material less than or equal to the size of the compressible particles via screens; providing the second flow to a centrifuge; and separating undamaged compressible particles from the variable density drilling mud, cuttings and damaged compressible particles in the centrifuge. As a fourth alternative, the separation of the damaged compressible particles from the undamaged compressible particles may include receiving the variable density drilling mud and cuttings from the wellbore; removing material greater than or equal to the size of the compressible particles; providing the removed material to a settling tank to separate compressible particles from the remaining material by density.

Further, the combination of the compressible particles and the drilling fluid may be performed in various embodiments, which are at the surface or within the wellbore. For example, the combination of the compressible particles and the drilling fluid may include blending the compressible particles with the drilling fluid to form the variable density drilling mud in a mud pit; monitoring the density of the variable density drilling mud; and pumping the variable density drilling mud into the wellbore. As a second embodiment, the combination of the compressible particles and the drilling fluid may include blending the compressible particles with the drilling fluid in a monitor to form the variable density drilling mud; and pumping the variable density drilling mud into the wellbore. As a third embodiment, the combination of the compressible particles and the drilling fluid may include blending the compressible particles with the drilling fluid to form the variable density drilling mud in a storage vessel; compressing the variable density drilling mud in compression pumps; and providing the compressed variable density drilling mud to rig pumps via piping; and pumping the compressed variable density drilling mud into the wellbore. As a fourth embodiment, the combination of the compressible particles and the drilling fluid may include pumping the compressible particles through a primary flow path into the wellbore; pumping the drilling fluid through a secondary flow path into the wellbore; and blending the compressible particles and drilling fluid in a blending section of the wellbore. In this embodiment, the primary flow path may be a parasite string and the secondary flow path may be drill pipe or the primary flow path and the secondary flow path may be provided from a dual walled drill string.

In a third embodiment, a method associated with the production of hydrocarbons is described. The method includes circulating a variable density drilling mud in a wellbore, wherein the variable density drilling mud maintains the density of a drilling mud between the pore pressure gradient (PPG) and the fracture pressure gradient (FG) for drilling operations and comprises compressible particles with a drilling fluid; diverting at least a portion of compressible particles from the variable density drilling mud to manage the use of the compressible particles; disposing devices and a production tubing string within the wellbore; and producing hydrocarbons from the devices via the production tubing string.

Moreover, in one or more of the embodiments above, a density monitor may be used to analyze or review compressible particles in the variable density drilling mud. For example, in embodiments with a mud pit, one or more monitors of at least 1 atmosphere density, which may measure density up to a pressure as high as those experienced in the system, may be used to determine density responses of variable density drilling mud to various levels of applied pressure. That is, the monitors may review or analyze the density behavior as a function of pressure and temperature as the variable density drilling mud enters the drill string and/or exits the wellbore to determine attrition rates and provide real-time estimates of the density/pressure profile within the wellbore.

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The present technique is directed to a method and apparatus for managing compressible particles utilized with a drilling fluid to provide a variable density drilling mud for drilling operations in a well. Because the compressible particles may include spheroids, ellipsoids, or the like, a method and apparatus for managing these compressible particles during drilling operations may be beneficial to maintain the drilling mud density between the pore pressure gradient (PPG) and the fracture pressure gradient (FG). Accordingly, drilling operations may include any process where surface fluids are used to achieve and maintain a desired hydrostatic pressure in a wellbore and/or the processes of circulating this fluid to, among other uses, remove formation cuttings from the wellbore. Because compressible particles are utilized in the variable density drilling mud, the present techniques relate to removal, circulation, and insertion of the compressible particles into the drilling fluid. Further, it should be noted that the following methods and procedures are not limited to drilling operations, but may also be utilized in completion operations, or any processes that use surface stored/prepared fluids having compressible particles.

To begin, the present techniques involve the use of compressible particles and a drilling fluid, which may be referred to as a variable density drilling mud. As noted in Intl. Patent Application Publication No. WO 2006/007347, which is incorporated by reference, the compressible particles may include compressible or collapsible hollow objects of various shapes, such as spheres, cubes, pyramids, oblate or prolate spheroids, cylinders, pillows and/or other shapes or structures. These compressible hollow objects may be filled with pressurized gas, or even compressible solid materials or objects. Also, the compressible particles, which are selected to achieve a favorable compression in response to pressure changes, may include polymer, polymer composites, metals, metal alloys, and/or polymer or polymer composite laminates with metals or metal alloys. As such, the present techniques may include drilling fluid combined with various compressible particles (i.e. mixing hollow objects that collapse at different pressures) configured to maintain the mud weight or density between the FG and PPG.

Figure 1:
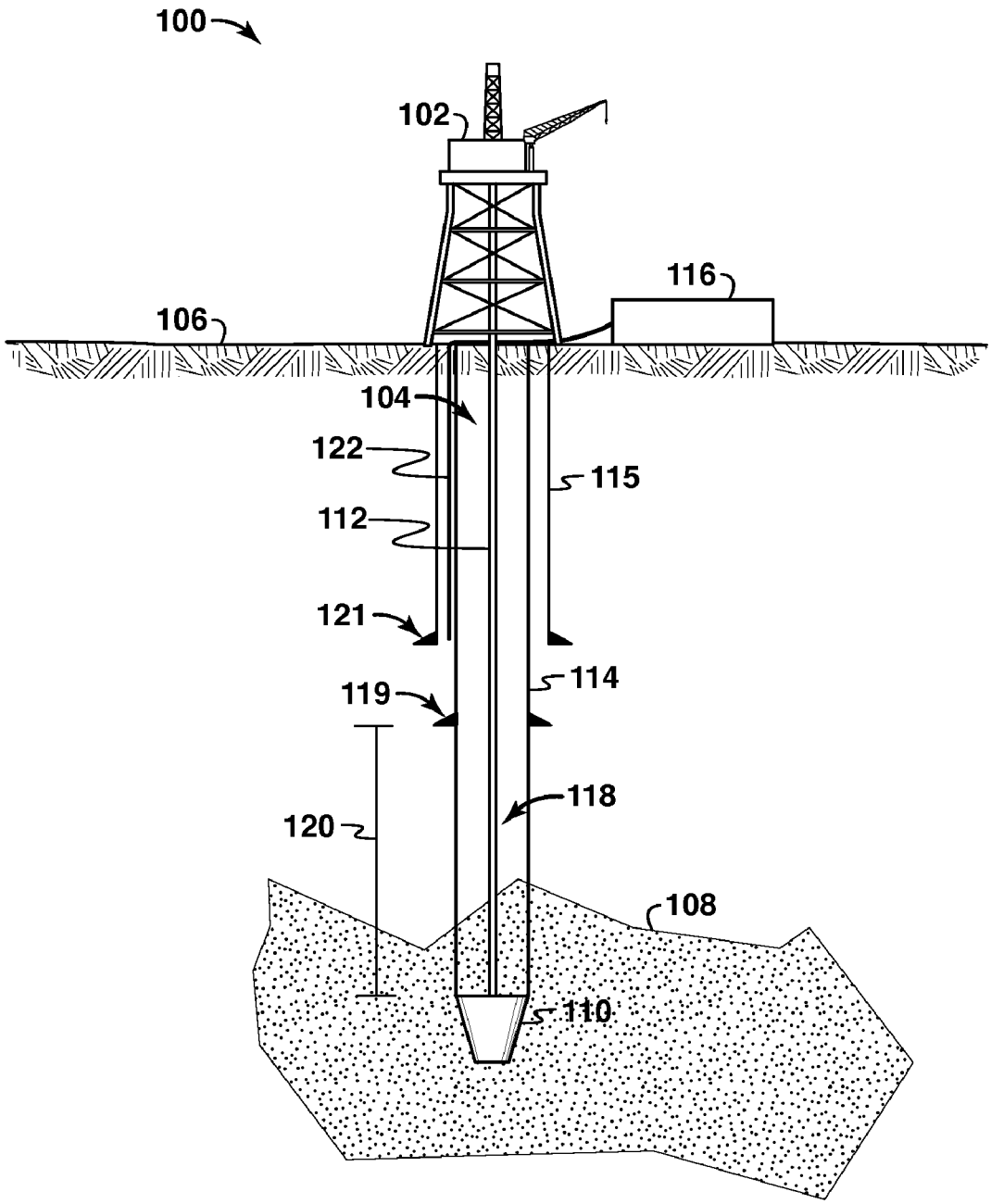
FIG. 1 is an illustration of an exemplary drilling system in accordance with certain aspects of the present techniques.

Turning now to the drawings, and referring initially to FIG. 1, an exemplary drilling system 100 in accordance with certain aspects of the present techniques is illustrated. In the exemplary drilling system 100, a drilling rig 102 is utilized to drill a well 104. The well 104 may penetrate the surface 106 of the Earth to reach the subsurface formation 108. As may be appreciated, the subsurface formation 108 may include various layers of rock (not shown) that may or may not include hydrocarbons, such as oil and gas, and may be referred to as zones or intervals. As such, the well 104 may provide fluid flow paths between the subsurface formation 108 and production facilities (not shown) located at the surface 106. The production facilities may process the hydrocarbons and transport the hydrocarbons to consumers. However, it should be noted that the drilling system 100 is illustrated for exemplary purposes and the present techniques may be useful in accessing and producing fluids from any subsurface location, which may be located on land or water. The well 104 although shown as vertical may be a deviated or horizontal.

To access the subsurface formation 108, the drilling system 100 may include drilling components, such as bottom hole assembly (BHA) 110, drill pipe 112, casing strings 114 and 115, parasite strings 122, drilling mud processing unit 116 for processing the variable density drilling mud 118 and other systems to manage drilling and production operations. The BHA 110 may include a drill bit, bit nozzles, separators and other components that are utilized to excavate the formation, cement the casing strings, separate compressible particles from the variable density drilling mud 118 or perform other drilling operations within the wellbore. The casing strings 114 and 115 may provide support and stability for access to the subsurface formation 108, which may include a surface casing string 115 having a casing shoe 121 and one or more intermediate or production casing strings 114 having a casing shoe 119. The production casing string 114 may extend down to a depth near the subsurface formation 108 with an open hole section 120 extending from the casing shoe 119 through the subsurface formation 108. The parasite strings 122 may provide an alternative flow path through a portion of the well 104 to provide compressible particles of the variable density drilling mud 118 to specific locations. The parasite string 122, which is shown in the annulus between the casing strings 114 and 115, may also be disposed within the casing string 114. The drilling mud processing unit 116 is utilized to manage the slurry (i.e. variable density drilling mud 118 and cuttings) from the wellbore and provide the formulated variable density drilling mud 118 to the wellbore for drilling operations. The drilling fluids processing unit 116 may include pumps, hydrocyclones, separators, screens, mud pits, shale shakers, desanders, desilters, centrifuges and the like.

During the drilling operations, the use of a variable density drilling mud 118 as a drilling mud allows the operator to drill deeper below the surface 106 with longer uncased intervals, maintain sufficient hydrostatic pressure, prevent an influx of formation fluid (gas or liquid), and remain below the FG that the formation can support. The BHA 110 and drilling mud processing unit 116 may be utilized to manage the compressible particles in the variable density drilling mud 118. That is, the BHA 110 and drilling mud processing unit 116 may remove, circulate and reinsert the compressible particles within the variable density drilling mud 118 to enhance the drilling operations. Accordingly, a method for managing the variable density drilling mud 118 is discussed further below in FIG. 2.

Figure 2:
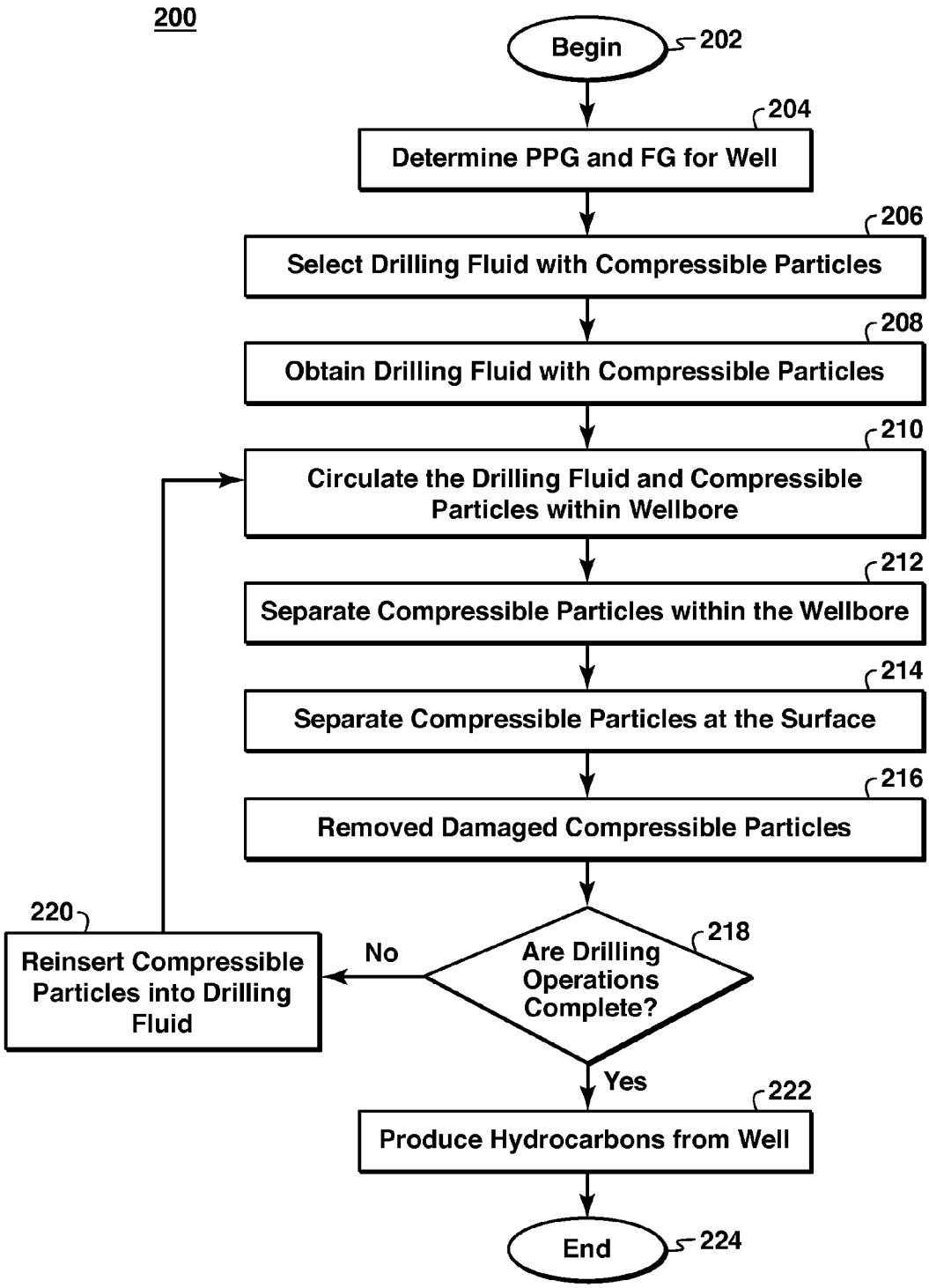
FIG. 2 is an exemplary flow chart utilized in the drilling system of FIG. 1 in accordance with certain aspects of the present techniques.

FIG. 2 is an exemplary flow chart for operating the drilling system 100 of FIG. 1 in accordance with certain aspects of the present techniques. This flow chart, which is referred to by reference numeral 200, may be best understood by concurrently viewing FIG. 1. In this flow chart 200, a process may be utilized to enhance the drilling operations by utilizing compressible particles as part of a variable density drilling mud 118. This process may enhance the drilling operations by managing the compressible particles utilized to form the variable density drilling mud. Accordingly, drilling operations performed in the described manner may reduce inefficiencies by eliminating or reducing additional casing strings from drilling operations.

The flow chart begins at block 202. At block 204, the FG and PPG for a well may be determined. For example, the PPG may be determined from prior drilling, taking a kick, evidence of connection gas, downhole tool, or modeling. The FG may be determined from leak-off tests, evidence of lost returns and/or modeling. Then, a drilling fluid may be selected with certain compressible particles, as shown in block 206. The selection of the drilling fluid and compressible particles may be based upon International Patent Application No. WO 2006/007347. For instance, the selection of drilling fluid and compressible particles may include compressible (or collapsible) hollow or at least partially foam filled objects made of polymer, polymer composites, metals, metal alloys, and/or polymer or polymer composite laminates with metals or metal alloys. The drilling fluid may be tailored to have certain properties based on the specific well application.

Once the variable density drilling mud (i.e. drilling fluid and compressible particles) is selected, the drilling operations may be performed in blocks 208-212. In block 208, the drilling fluid with the compressible particles may be obtained. The drilling fluid and compressible materials may be shipped to the drilling location blended together or separately. At block 210, the drilling fluid and the compressible particles may be circulated within the wellbore. The drilling fluid and compressible particles are configured to maintain the drilling fluid weight between the FG and PPG, as discussed above. Then, the compressible particles may be separated from the drilling fluid at the bottom hole assembly 110, as shown in block 212. In particular, the compressible particles may be removed prior to reaching the bit nozzles or drill bit to reduce potential damage to the compressible particles. The separation of the compressible particles may be performed at various locations above the drill bit, which is part of the bottom hole assembly 110. The separation may occur directly above the drill bit or at any location along the BHA 110. That is, the compressible particles of different densities may be separated from the drilling mud at various locations. To shunt the compressible particles around the drill bit, a separator, such as an in-line centrifugal separator or other equipment, may be utilized, as discussed further below with reference to FIGS. 5A-5B.

In blocks 214-220, the compressible particles may be further processed to separate, examine and reinsert the compressible particles into the drilling fluid for further drilling operations. At block 214, the compressible particles may be separated from the variable density drilling mud 118 and cuttings, which may be referred to as slurry. The process of removing the compressible particles from the variable density drilling mud, which may be performed at the surface, may include the use of a centrifuge or other active separation methods and/or a settling tank or other passive separation methods, which are part of the drilling mud processing unit 116. These various methods are discussed further below in FIG. 3A-3D. At block 216, the damaged compressible particles are removed. The removal of damaged or failed compressible particles may include shaker screens, settling tanks, hydrocyclones, centrifuges and the like. Then, a determination is made whether the drilling operations are complete in block 218. If the drilling operations are not complete, the compressible particles may be reinserted into the drilling fluid in block 220. The methods for reinserting compressible particles into the drilling fluid may include aggressive remixing in mud pits after separation and cleanup; venturi at the mud pump inlet to induct compressible particles into the drilling fluid; direct injection using specially designed pumps; a parasite string to introduce compressible particles downhole and/or a dual walled drill string to introduce compressible particles as a slurry just above the drill bit. Each of the methods is discussed further below in FIGS. 4A-4E.

However, if the drilling operations are complete, the hydrocarbons may be produced from the well 102 in block 222. The production of hydrocarbons may include completing the wellbore, installing devices within the wellbore along with a production tubing string, obtaining the hydrocarbons from the subsurface reservoir, processing the hydrocarbons at a surface facility and/or other similar operations. Regardless, the process ends at block 224.

Methods of Surface Separation of Compressible Particles from the Variable Density Drilling Mud:

As discussed above in block 214, several methods may be utilized to separate compressible particles, such as solid or hollow objects, from the variable density drilling mud 118 at the surface 106. Typically, the drilling mud processing units 116 may include basic surface mud cleaning equipment located on drilling rigs, such as scalpers, shale shakers to remove formation cuttings from the flow path based on their size, desanders, desilters and centrifuges for separating particles out of the drilling mud by differences in weight/density. Accordingly, this type of equipment may be utilized to separate the compressible particles and the drilling fluid based on the properties of the specific compressible particles, which may be positively or negatively buoyant. For instance, if the compressible particles are in the uncompressed state, the compressible particles, which may include a gas and gas impermeable membrane, may have a density that is less than the drilling fluid and cuttings in the slurry. Therefore, the compressible particles are positively buoyant and naturally float to the surface of the slurry. The buoyancy force counters the viscous properties of the slurry and/or the interaction of multiple uncompressed compressible particles.

Figure 3A:
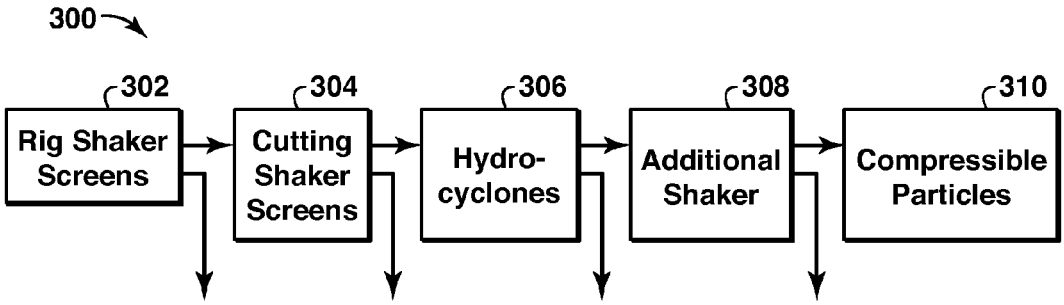
FIGS. 3A-3D are exemplary configurations for the removal of compressible particles in accordance with certain aspects of the present techniques.

Accordingly, various different embodiments may be utilized as part of the drilling mud processing units 116, which are shown in FIGS. 3A-3D. In a first embodiment, a compressible particles recovery unit 300 may be part of the drilling mud processing units 116 and used to isolate the compressible particles from the slurry, which is shown in FIG. 3A. The compressible particles recovery unit 300 may include one or more shaker screens 302, 304 and 308 and one or more hydrocyclones 306. In particular, the compressible particles recovery unit 300 may be a Drill Bead Recovery Unit from Alpine Mud Products with various modifications based on the compressible particles, which may include optimizing screen sizing and the hydrocyclone's operation. In this compressible particles recovery unit 300, rig shaker screens 302 are sized to capture material equal to or greater than the size of the compressible particles 310, which may also include formation cuttings. The slurry is divided into a first shaker flow path of material equal to or greater than the size of the compressible particles 310 and a second shaker flow path of other cuttings in the slurry. The remaining cuttings and compressible particles 310 in the slurry of the first shaker flow path pass over cutting shaker screens 304 that pass the compressible particles 310 through, while rejecting the larger cuttings. Again, through the cutting shaker screens 304, the slurry is divided into a first cutting flow path of compressible particles 310 and other material equal to or smaller than the compressible particles 310 and the second cutting flow path of material greater than the size than the compressible particles 310. Then, the compressible particles 310 are concentrated in one or more hydrocyclones 306 because in the uncompressed state the compressible particles 310 may have low density compared to the remaining cuttings or liquid drilling mud. The hydrocyclones 306 accelerate the remaining slurry radially and establish a density gradient where the lightest material (i.e. compressible particles 310, for example) migrate out of the top of the hydrocyclone along a first hydrocyclone flow path and the heavier material migrates out the bottom into a second hydrocyclone flow path. Accordingly, from the hydrocyclones 306, the remaining slurry is divided into a first hydrocyclone flow path of material having a density similar to the compressible particles 310 and a second hydrocyclone flow path of other material having a density different from the compressible particles 310. For example, the damaged compressible particles may be part of the second flow path. The other material may be lighter or heavier than the compressible particles depending on the specific application. Finally, the compressible particles 310 are recovered from the entrained fluid or first hydrocyclone flow path via additional shaker screens 308, which separate the compressible particles from the other material in the remaining slurry.

Figure 3B:
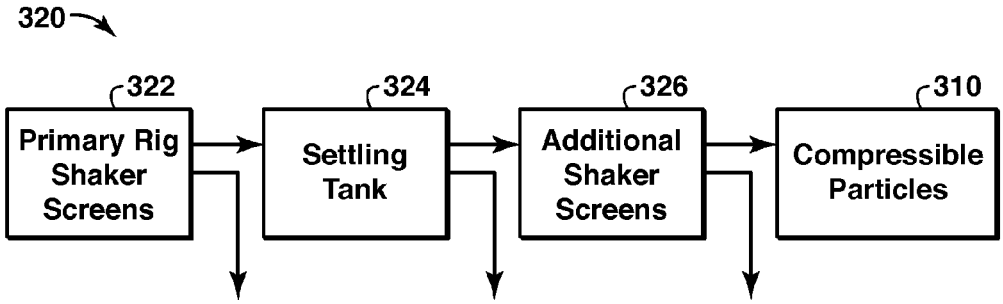

In a second embodiment, the compressible particles recovery unit 320, which is part of the drilling mud processing units 116, may include two or more rig shaker screens 322 and 326 and settling tanks 324 as shown in FIG. 3B. In this embodiment, the slurry from the wellbore passes across primary rig shaker screens 322 to remove material greater than the size of the compressible particles 310. The slurry is divided into a first shaker flow path of material greater than the size of the compressible particles 310 and a second shaker flow path of the material equal to or smaller than the compressible particles 310 in the slurry. The remaining slurry containing cuttings and compressible particles 310 in the second shaker flow path are then transferred to one or more settling tanks 324 of sufficient volume to allow separation by density. Particle settling is a function of particle size, particle density, suspending fluid density and suspending fluid viscosity. The settling time of the compressible particles 310 is significantly less than the settling time of any weighting agent (e.g. barite or hematite) suspended in the slurry primarily due to their relative size. For example, large particles of about 1 mm (millimeter) in diameter with a density of 5 ppg (pounds per gallon) in a 15 ppg drilling fluid with a viscosity of 10 centipoises rise at 0.03 msec (meters per second). Small particles of about 50 micron in diameter with a density of about 35 ppg in a 7 ppg drilling fluid base oil with a viscosity of 10 centipoises fall at $5\times10^{-4}$ msec. The residence time in the settling tanks 324 is long enough to ensure that the compressible particles 310 float to the surface. For example, in a 6 foot deep tank, a compressible particle may rise to the surface in about 1 minute. It should be noted that this settling time may vary for different compressible particles and drilling fluid. Then, the compressible particles 310 are separated based on the density. For instance, if the compressible particles 310 are lighter than the cuttings and other material, the compressible particles may be skimmed off the top of the settling tank 324 or passed over secondary shaker screens 326 to remove them from the slurry along a first settling flow path. The other material in the slurry, which may include damaged compressible particles, cuttings, or other material having higher density, may be removed through a bottom valve or other methods along a second settling flow path. For instance, the settling tanks 324 may be designed with hopper style bottoms to be periodically drained of any cuttings or may include an auger screw configuration to continuously move high density material that have settled within the settling tanks 324.

In an alternative modification to the second embodiment, the compressible particles recovery unit 320 may separate the compressible particles from larger cuttings in the settling tanks. In this alternative embodiment, the slurry from the wellbore passes across primary rig shaker screens 322 to remove material greater than or equal to the size of the compressible particles 310. The slurry is divided into a first shaker flow path of material greater than and equal to the size of the compressible particles 310 and a second shaker flow path of the material smaller than the compressible particles 310. The cuttings and compressible particles 310 in the first shaker flow path are then transferred to one or more settling tanks 324 of sufficient volume to allow separation by density. In particular, if the compressible particles 310 are lighter than the cuttings and other material, the compressible particles may be skimmed off the top of the settling tank 324 or passed over secondary shaker screens 326 to remove them from the slurry along a first settling flow path. The other material in the slurry, which may include damaged compressible particles, cuttings, or other material having higher density, may be removed through a bottom valve or other methods along a second settling flow path.

Figure 3C:
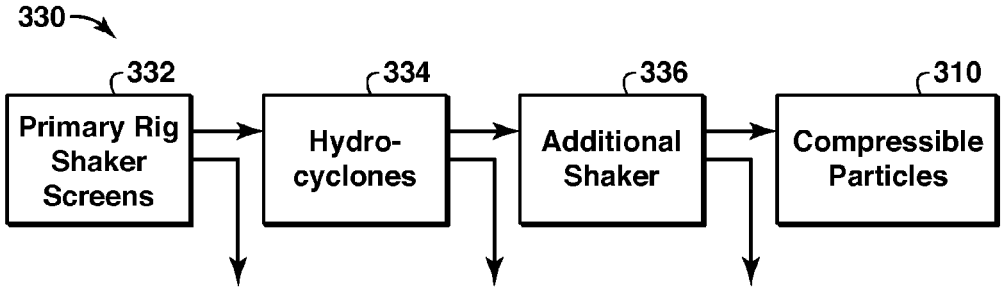

In a third embodiment, the compressible particles recovery unit 330, which is part of the drilling mud processing units 116, may include two or more shakers screens 332 and 336 and one or more hydrocyclones 334, which is shown in FIG. 3C. In this embodiment, the slurry from the wellbore passes across the primary rig shaker screens 332 to remove material greater than the size of compressible particles 310. The slurry is divided into a first shaker flow path of material greater than the size of the compressible particles 310 and a second shaker flow path of material in the slurry equal to or smaller than the size of the compressible particles 310. The material retained on the primary rig shaker screens 332 may be discarded as cuttings. The remaining slurry with compressible particles 310 in the second shaker flow path is transferred to the hydrocyclones 334 that accelerate the remaining slurry radially and establish a density gradient where the lightest material (i.e. compressible particles 310, for example) migrate out of the top of the hydrocyclone along a first hydrocyclone flow path and the heavier material migrates out the bottom into a second hydrocyclone flow path. Additional shaker screens 336 are then used to remove the compressible particles 310 from the slurry that exits the top of the hydrocyclones 334 along the first hydrocyclone flow path.

Figure 3D:
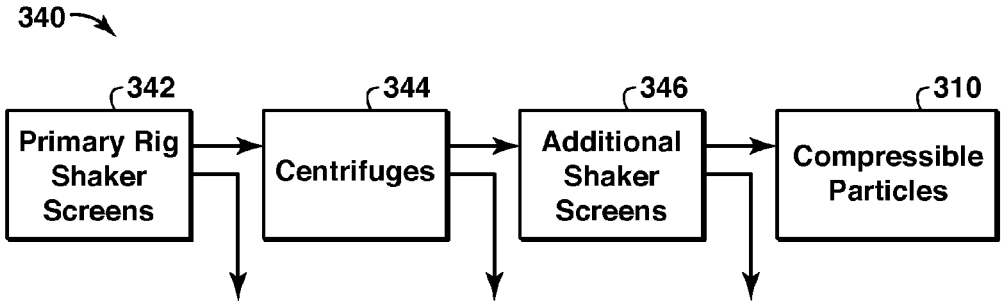

In a fourth embodiment, the compressible particles recovery unit 340, which is part of the drilling mud processing unit 116, may include two or more shakers screens 342 and 346 and centrifuges 344, which is shown in FIG. 3D. In this embodiment, the slurry from the wellbore passes across the primary rig shaker screens 342 to remove material greater than the size of the compressible particles 310. The slurry is divided into a first shaker flow path of material greater than the size of the compressible particles 310 and a second shaker flow path of material in the slurry equal to or smaller than the size of the compressible particles 310. The remaining slurry with compressible particles 310 in the second shaker flow path is then transferred to centrifuges 344. In the centrifuges 344, the compressible particles 310 are separated from the other material, which may have a higher or lower density. For instance, if the compressible particles 310 are lighter than the other cuttings, compressible particles 310 migrate with other light density material along a first centrifuge flow path and the heavier material migrates along a second centrifuge flow path. Then, additional shaker screens 346 are used to remove the compressible particles 310 from the first centrifuge flow path.

Methods for Separating Failed or Damaged Compressible Particles from Variable Density Drilling Mud:

As discussed above with regard to block 212, several methods may be utilized to separate damaged or failed compressible particles from the variable density drilling mud. It is envisioned that over time, some fraction of the compressible particles in the variable density drilling mud may rupture or fail due to the stresses imposed during drilling operations. The damage may include damage from interactions between the drill bit and the formation, between rotating drill pipe and formation or casing strings, shear forces if the compressible particles are sent through drill bit nozzles, rapid compression and shear forces if the compressible particles are passed through mud pumps, or cyclic loading of compression/expansion as the compressible particles circulate through the wellbore. Further, if the compressible particles are formulated by sealing a low density gas inside an impermeable shell, the sealed gas may be released by mechanical failure into the variable density drilling mud and the shell's higher density is no longer buoyant (i.e. tends to sink if the shell material of the compressible particles is negatively buoyant). Then, the previously sealed gas may be released from the variable density drilling mud at the surface, while the shell may settle by gravity according to its material density.

Regardless, the drilling mud processing units 116 may be utilized to remove these damaged compressible objects. Again, because the density of the compressible particles may be less than the drilling fluid and cuttings in the uncompressed state, the undamaged compressible particles are positively buoyant and naturally float to the surface of the slurry at atmospheric conditions, while the damaged compressible particles have a density equal to that of the shell material. As a result, the methods and embodiments described above in FIGS. 3A-3D may be utilized to segregate the damaged compressible particles from the slurry. In this manner, both damaged and undamaged compressible particles are removed using the shaker screens along with other equipment. That is, the material greater than or equal to the size of the compressible particles is initially separated from the slurry. Then, the damaged compressible particles and smaller cuttings in the slurry are separated by density from the compressible particles based on the various methods described above. For instance, in the settling tank, the undamaged compressible particles may float, while the damaged compressible particles may sink. In this example, the damaged compressible particles may be disposed of properly with other cuttings or may be recovered for recycling of the shell material.

Methods for Reinserting Compressible Objects into the Drilling Fluid Stream:

As discussed above in blocks 208 and 220, several methods may be utilized to mix or combine the compressible particles with the drilling fluid to create the variable density drilling mud 118. Typically, the drilling fluid may be delivered to the drilling site fully formulated without compressible particles. This may reduce the mud delivery volume and utilize the least number of supply trucks and/or boats. The drilling fluid may also be formulated on-site from raw materials. Regardless of the method to obtain the compressible particles and drilling fluid, the compressible particles may be mixed or combined to create the variable density drilling mud 118 prior to reaching the annulus near the drill bit of the bottom hole assembly 110. That is, the compressible particles may be introduced for the first time to the drilling operations when switching from a conventional mud to variable density drilling mud 118 or after the routine solids control operations at the surface. In addition, the surface weight or density of the drilling fluid with and without compressible particles may be monitored and compressible particles added to achieve the desired continuous gradient effect downhole.

Regardless of the method utilized to obtain the drilling fluid with the compressible particles, the drilling mud processing units 116 may be utilized to circulate the compressible particles with the drilling fluid to create the variable density drilling mud 118. The drilling mud processing units 116 may include pumps/mixers and other equipment to insert and reinsert the compressible particles into the wellbore or into the drilling fluid, which are shown in FIGS. 4A-4E. For example, in a first embodiment shown in FIG. 4A, a compressible particle insertion unit 400 may mix the compressible particles 410 with the drilling fluid 412. The compressible particle insertion unit 400 may include one or more mud pits 402, mixers 404, inlet monitors 406 and mud pumps 408. The compressible particles 410 and drilling fluid 412 are added to the mud pits 402 (i.e. suction pit or earlier) and thoroughly blended with mixers 404, such as paddle mixers and jet mixers. The mud density or weight of the material, which includes the compressible particles 410 and drilling fluid 412, in the mud pit 402 is monitored by inlet monitors 406. The blended material forms the variable density drilling mud 118 of FIG. 1 configured to provide the continuous gradient behavior within the wellbore. The variable density drilling mud is provided to the mud pumps 408, which may be provided at about 1 to 2 or more times the volumetric flow rate that the mud pumps 408 deliver to the wellbore via the flow path 409. Typically, the pressure at which the compressible particles compress into a contracted state may be exceeded by the mud pumps 408. Depending on total mud compressibility, the mud pumps 408 deliver the variable density drilling mud at a volumetric flow rate less than or equal to the intake volumetric flow rate for the mud pumps.

Figure 4A:
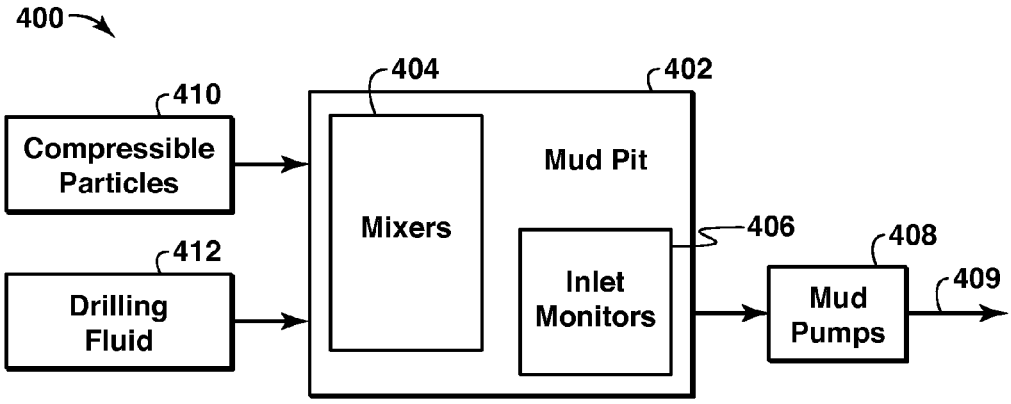
FIGS. 4A-4E are exemplary configurations for insertion of compressible particles in accordance with certain aspects of the present techniques.
Figure 4B:
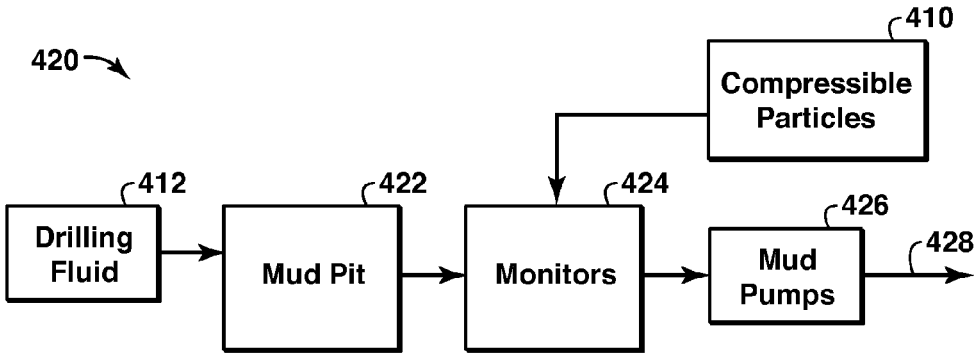

In a second embodiment, the compressible particles 410 may be blended with the drilling fluid in the monitors, as shown in FIG. 4B. In this embodiment, the compressible particle insertion unit 420 may include one or more mud pits 422, monitors 424 and mud pumps 426. The drilling fluid 412 is added to the mud pits 402 (i.e. suction pit or earlier). Then, the compressible particles 410 may be metered by monitors 424 that manage the amount of compressible particles 410 provided into the flow path 428 before entering the mud pumps 426. With this method, the compressible particles 410 may be introduced in a dry form or as concentrated slurry via a venturi. Again, the mud pumps 408 deliver the variable density drilling mud at a volumetric flow rate less than or equal to the intake volumetric flow rate of the mud pumps. The compressible particles 410 and the drill fluid 412 are combined for delivery to the wellbore via the flow path 428.

Figure 4C:
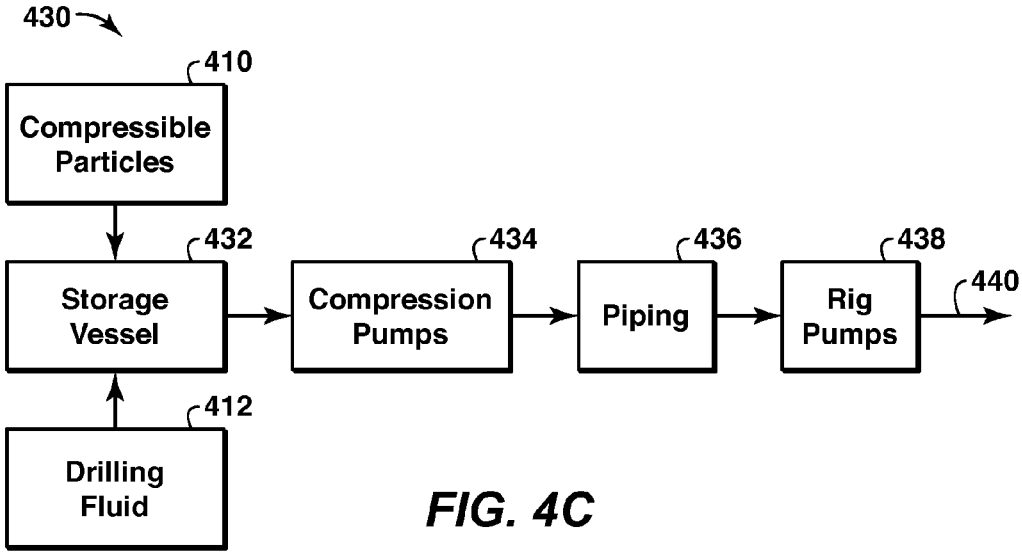

In a third embodiment, a dedicated pump or pump set may be used to apply pressure to concentrated compressible particle-mud slurry so that the particles are nearly fully compressed, as shown in FIG. 4C. The dedicated pump may be beneficial when the surface circulating pressure is enough to place the compressible particles into a compressed state prior to injection into the wellbore. In this embodiment, the compressible particle insertion unit 430 may include one or more storage vessels 432, compression pumps 434, piping 436 and rig pumps 438. The compressible particles 410 and drilling fluid 412 are combined in the storage vessel 432, which may be a mud pit or specific vessel. Then, the compression pumps 434 compress the variable density drilling mud from the storage vessel 432. The compressed variable density drilling mud, which includes the drilling fluid 412 and compressible particles 410, is introduced either upstream or downstream of the main rig pumps 438 through piping 436, which includes a series of check valves and manifolds to prevent backflow. This configuration reduces the amount of work provided by the main rig pumps 438 to compress the variable density drilling mud.

Figure 4D:
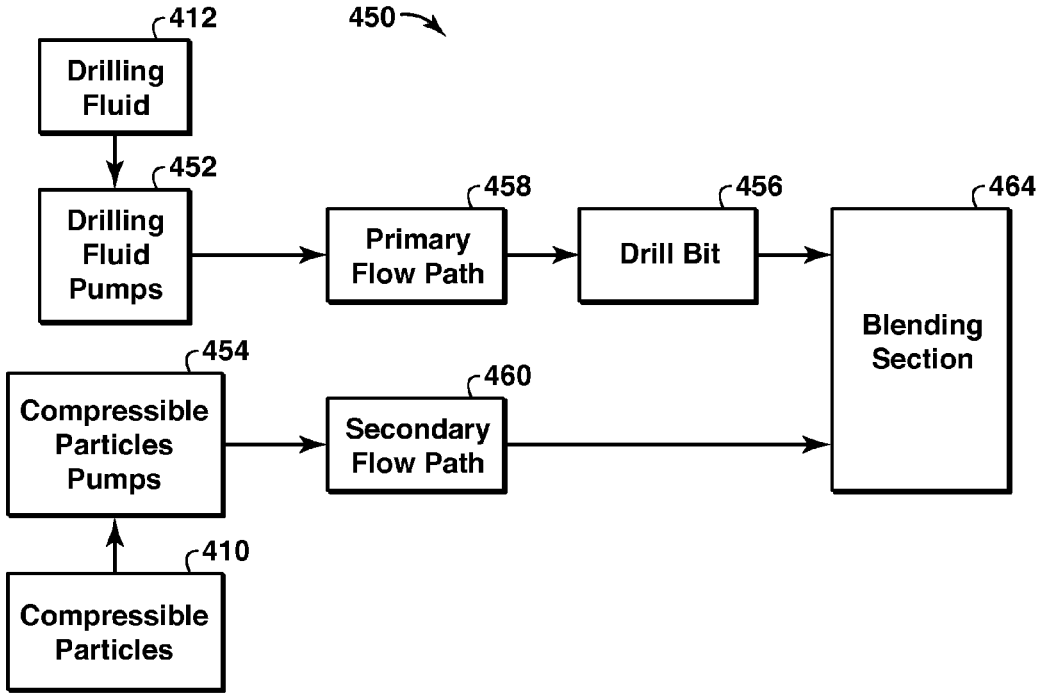

In a fourth embodiment, the drilling fluid and compressible particles 410 are isolated until reaching the annulus in the wellbore near the drill bit, as shown in FIG. 4D. Because the continuous gradient or variable density behavior is utilized in the annulus of the wellbore, the compressible particles may be mixed with the drilling fluid within the wellbore annulus. In this embodiment, the compressible particle insertion unit 450 may include one or more drilling fluid pumps 452, compressible particles pumps 454, drill bit 456, and dual-walled drill pipe string having an inner pipe and an outer pipe that create a primary flow path 458 and a secondary flow path 460. With the dual-walled drill pipe string, a first fluid, such as the drilling fluid 412, is pumped down the primary flow path 458, which is within the inner pipe by the drilling fluid pumps 452. The second fluid, such as the compressible particles 410 with some portion of drilling fluid, is pumped down the second flow path 460, which is the annulus between the inner pipe and outer pipe, by the compressible particles pumps 454. The drilling fluid 412 passes through the drill bit 456 and is circulated to a blending section 464 located above the drill bit 456, while the compressible particles 410 exit directly into the blending section 464. The volumetric flow rate of the individual fluids is preferably controlled to provide the desired concentration of compressible particles 410 in a blending section 464, which may be the annulus above the drill bit 456.

Figure 4E:
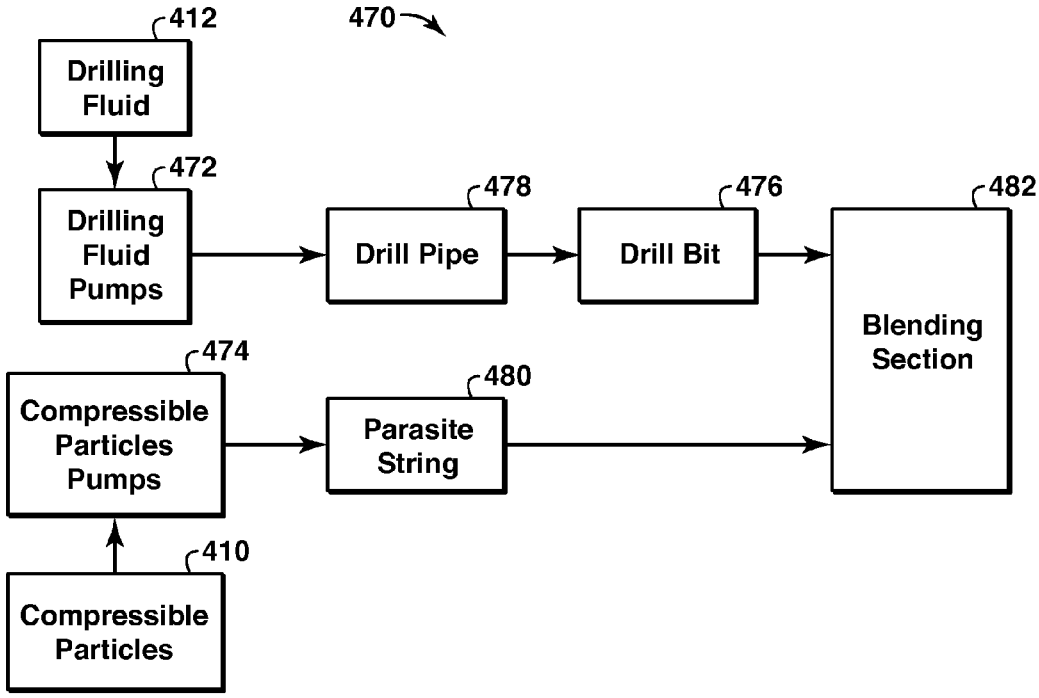

In a fifth embodiment, the drilling fluid and compressible particles 410 are isolated until reaching an injection port on a parasite pipe, as shown in FIG. 4E. Because the continuous gradient or variable density behavior is utilized in the annulus of the wellbore, the compressible particles are mixed with the drilling fluid 412 at an injection port. In this embodiment, the compressible particle insertion unit 470 may include one or more drilling fluid pumps 472, compressible particles pumps 474, drill bit 476, drill pipe 478, such as drill pipe 112, and a parasite string 480, such as parasite string 122. With this configuration, a first fluid, such as the drilling fluid 412, is pumped down the drill pipe 478 by the drilling fluid pumps 472, while the second fluid, such as the compressible particles 410, is pumped down the parasite string 480 by the compressible particles pumps 474. The drilling fluid 412 passes through the drill bit 476 and is circulated to a blending section 482 located above the drill bit 476, while the compressible particles 410 exit directly into the blending section 482 from the outlet of the parasite string 480. The volumetric flow rate of the individual fluids is controlled to provide the desired concentration of compressible particles 410 in a blending section 482, which may be the annulus of the well near the casing string 114 or the drill bit 476.

As a specific example, a drilling system may utilize a variable density drilling mud that is a mixture of drilling fluid with a density of 15 pounds per gallon (ppg) and compressible particles having a uncompressed state density of 4.8 ppg with the compressible particles configured to compress above 1500 pounds per square inch (psi). Referring to FIG. 1, these particles may be injected into the wellbore via the parasite string 122 with the compressible particles being 40% of the volume of the variable density drilling mud 118 when in the uncompressed state. Below the injection port, no compressible particles are present and the mud may have a density of 15 ppg. Above the injection port, the density of the variable density drilling mud may adjust based on the expansion of the compressible particles. Above the depth where the annular pressure is less than 1500 psi, the variable density drilling mud has constant density because the compressible particles have expanded to the uncompressed state. Accordingly, the density of the variable density drilling mud may be tailored by adjusting the collapse pressure of the compressible particles, the number of compressible particles and the drilling fluid density.

Beneficially, the present techniques reduce or prevent damage to the compressible particles. In addition, the present technique may be utilized to manage well control issues, such as kicks and underground flow. For instance, a well control event may occur in a well. To manage the well control event, the flow of compressible particles from the parasite string 122 may be instantaneously stopped from the surface. In this manner, only compressible particles within the wellbore above the injection point are present within the well, while the drill pipe contains regular mud, i.e., without compressible particles. The compressible particles contained in the wellbore above the injection point may be circulated back to the surface by injecting mud with higher or lower density through the parasite string, while the drill pipe is shut. This technique allows well control issues to be resolved in a manner that is easier to implement than by circulating drilling mud through the drill pipe.

Method for Separation of the Compressible Particles Downhole:

As discussed above in block 212, the compressible particles may be separated within the wellbore to reduce potentially negative impact of high shear on the compressible particles. For example, the compressible particles may be isolated from the flow path inside the drill pipe 112 and directed to the annulus above the bottom hole assembly 110. Removing the compressible particles from the flow path inside the drill pipe 112 may avoid high shear regions in and around the bit nozzles and prevent the compressible particles from undergoing additional mechanical deformation and wear. Further, it may also keep the compressible particles away from potentially destructive downhole mud motors or turbines that are driven by fluid flow.

Figure 5A:
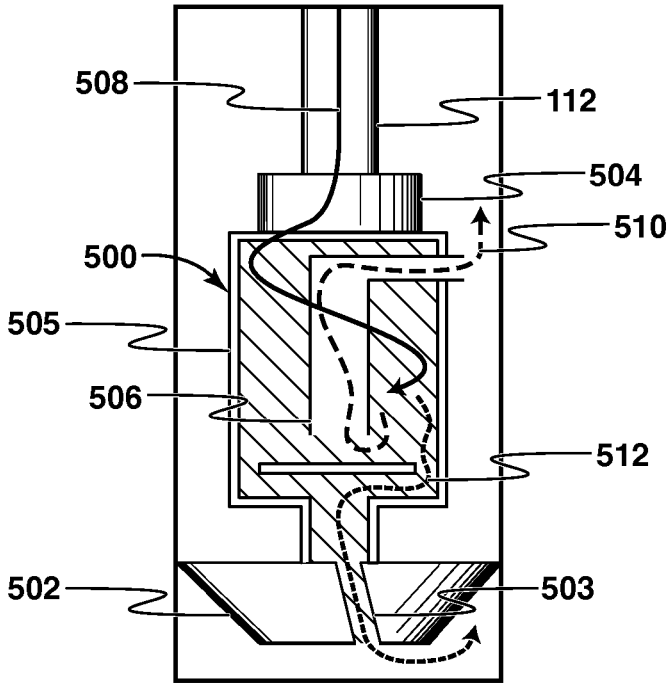
FIGS. 5A-5B are exemplary embodiments of a separator for removing compressible particles downhole in accordance with certain aspects of the present techniques.

The removal of compressible particles may be adjusted based on the density of compressible particles relative to the drilling fluid. For instance, as shown in FIG. 5A, if the drilling fluid is heavier than the compressible particles, the compressible particles may be separated in a downhole separator 500. The downhole separator 500, which is a part of the bottomhole assembly (BHA) 110, may be utilized within the wellbore to divert or separate the compressible particles from the variable density drilling mud 118. The downhole separator 500 may be a centrifugal separator or hydrocyclone that is located above the drill bit 502 and attached to the drill pipe 112. The separator 500 may include a flow diverter 504, a main chamber 505 and a bypass tube 506.

Similar to hydrocyclones used for separating compressible particles at the surface, a downhole separator 500 may be placed above other BHA components to accelerate the variable density drilling mud 118 from the drill pipe 112 in a circular or spiral fashion to induce centrifugal acceleration, as shown by solid line 508. As the variable density drilling mud 118 is accelerated, the heavier mud components migrate to the outside wall of the main chamber 505 and exit through a bit nozzle 503, as shown by dotted line 512. The lighter drilling mud components migrate to the middle or center of the main chamber 505 and enter into the bypass tube 506, as shown by dashed line 510. Even in a compressed state, the density of the compressible particles may be less than that of the drilling fluid. As such, the middle portion of the flow path containing the highest concentration of compressible particles is diverted to the wellbore annulus through an opening in the downhole separator, which is the bypass tube 506, while other remaining fluid flow is diverted toward the drill bit 502. The fluid from these flow paths is then mixed with the annular fluid above the drill bit 502 to achieve the variable density drilling mud 118.

Figure 5B:
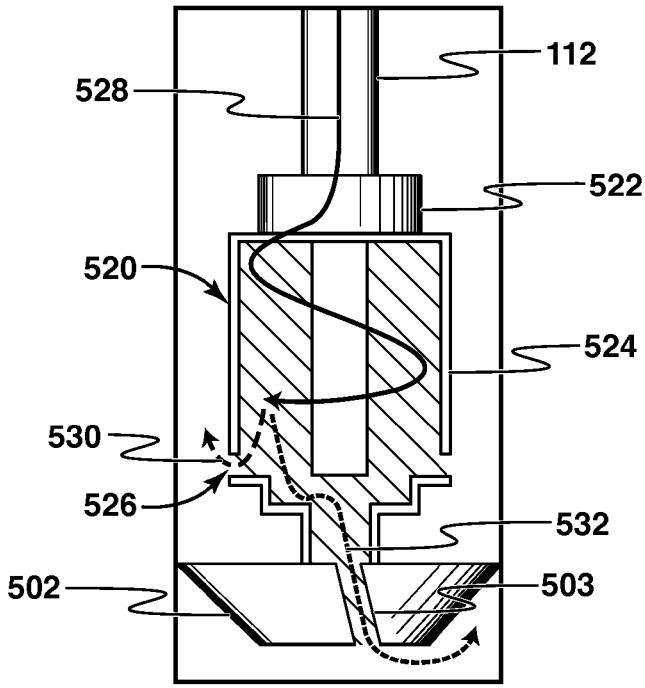

In an alternative embodiment, as shown in FIG. 5B, if the compressible particles in the compressed state are heavier than the drilling fluid, the flow paths may be altered to form a different separator 520. In this separator 520, which may again be located above the drill bit 502, the flow diverter 522 and main chamber 524 may function similar to the discussion above. However, the bypass tube 526 may divert heavier material, such as the compressible particles, in the variable density drilling mud 118 into the annulus from an outside wall of the main chamber 524. Again, the downhole separator 520 may be placed above other BHA components to accelerate the variable density drilling mud 118 from the drill pipe 112 in a circular or spiral fashion to induce centrifugal acceleration, as shown by solid line 528. As the variable density drilling mud 118 is accelerated, the heavier components, such as the compressible particles in the compressed state, migrate to the outside wall of the main chamber 524, as shown by dashed line 530. The lighter materials, which may be the drilling fluid, migrate to the middle of the main chamber 524 and flow out the main chamber 524 through the bit nozzle 503, as shown by dotted line 532. Near the bottom of the downhole separator 520, the outer portion of the fluid flow near the wall of the main chamber 524 contains the highest concentration of compressible particles and is diverted to the wellbore annulus through an opening in the downhole separator, which is the bypass tube 526. The fluid from these flows is then mixed with the annular fluid above the drill bit 502 to achieve the variable density drilling mud 118.

Further, it should be noted that equipment at the surface of the drilling operations may be sized for larger volumetric flows than equipment associated with the downhole portions of the well. For instance, the inlet flow rate for the mud pumps at the surface of the wellbore may be larger than the flow rates for the BHA 110 because the compressed particles in the compressed state occupy less volume. That is, the flow rate of equipment within the wellbore may be substantially less than the flow rate of pumps at the surface because the compressible particles are in the compressed state. While this flow rate reduction may reduce hole cleaning functions of the variable density drilling mud 118, the size of the downhole equipment may be reduced to further reduce costs.

In addition, it should be noted that these various exemplary applications may be modified to address specific configurations of the compressible particles based on the density of the compressible particles. For instance, as noted above, the other material in the variable density drilling mud 118 may be lighter or heavier than the compressible particles depending on the specific application. At the surface, the compressible particles may tend to be in the expanded or uncompressed state. As a result, the compressible particles may be lighter than the other material in the variable density drilling mud 118, and may be removed as noted above. However, the drilling mud processing unit 116 may also be modified to remove compressible particles for any range of densities. Similarly, in the downhole sections of the wellbore, the compressible particles are typically in the compressed state. In these downhole intervals, the compressible particles may be lighter or heavier than other material in the variable density drilling mud 118. As such, the downhole separator may be configured in a variety of embodiments to separate the compressible particles based on the density of the compressible particles.

Moreover, it should also be noted that the compressible particles may include one, two, three or more types of compressible particles that have different characteristics, such as shapes, density and size. Again, the specific configuration of the drilling mud processing unit 116 and downhole separators 500 and 520 may be modified to manage these differences. For example, with regard to the drilling mud processing unit 116, the embodiments described above may manage the separation of the compressible particles having different characteristics. However, the drilling mud processing unit 116 may be modified to have a series of two or more shaker screens 302, 304, 308, 322, 326, 332, 336, 342 and 346 utilized with a series of one or more hydrocyclones 306 and 334 or centrifuges 344 that are configured to separate the different compressible particles from the flow paths. These adjustments may provide additional flow paths for the different sizes or densities of the compressible particles.

As a specific example of separation on the surface, the compressible particles recovery unit 330 may include the shaker screens 332 having a first primary shaker screen and a second primary shaker screen and hydrocyclones 334 having a primary and secondary hydrocyclones. In this embodiment, the first compressible particles are greater in size than the second compressible particles. The slurry from the wellbore passes across the first primary rig shaker screen to remove material greater than the size of a first compressible particles 310. The slurry is divided into a first primary shaker flow path of material greater than the size of the first compressible particles 310 and a second shaker flow path of material in the slurry equal to or smaller than the size of the first compressible particles. The material retained on the primary rig shaker screens may be discarded as cuttings. The remaining slurry with compressible particles in the second primary shaker flow path passes across the second primary rig shaker screen to remove material greater than the size of the second compressible particles. The slurry is divided into a third primary shaker flow path of material greater than the size of the second compressible particles and a fourth primary shaker flow path of material in the slurry equal to or smaller than the size of the second compressible particles. The material on the third primary shaker flow path is transferred to a primary hydrocyclone that separates the first compressible particles from other material to migrate out of the top of the primary hydrocyclone along a first primary hydrocyclone flow path and the heavier material migrates out the bottom into a second primary hydrocyclone flow path. The material on the fourth primary shaker flow path is transferred to the secondary hydrocyclone that separates the second compressible particles from other material to migrate out of the top of the secondary hydrocyclone along a first secondary hydrocyclone flow path and the heavier material migrates out the bottom into a second secondary hydrocyclone flow path. Additional shaker screens may then be used to remove the compressible particles from the slurry that exits the top of the hydrocyclones, which may be sized for the first or second compressible particles.

As a specific example of separation within the wellbore, the downhole separator 500 and 520 may be utilized to separate the compressible particles having different characteristics in a single downhole separator. However, other embodiments may include a series of downhole separators utilized to separate the individual compressible particles. For instance, two or more downhole separators may be utilized to remove the compressible particles in a two-stage process depending on the density of the compressible particles. For instance, if the first compressible particles in the compressed state are heavier than the drilling fluid and the second compressible particles are lighter in the compressed state than the drilling fluid, the downhole separator 500 may be coupled to the downhole separator 520 in series to remove the compressible particles at the different stages. Other embodiments may also be considered within the scope of this description of the embodiments.

Figure 6:
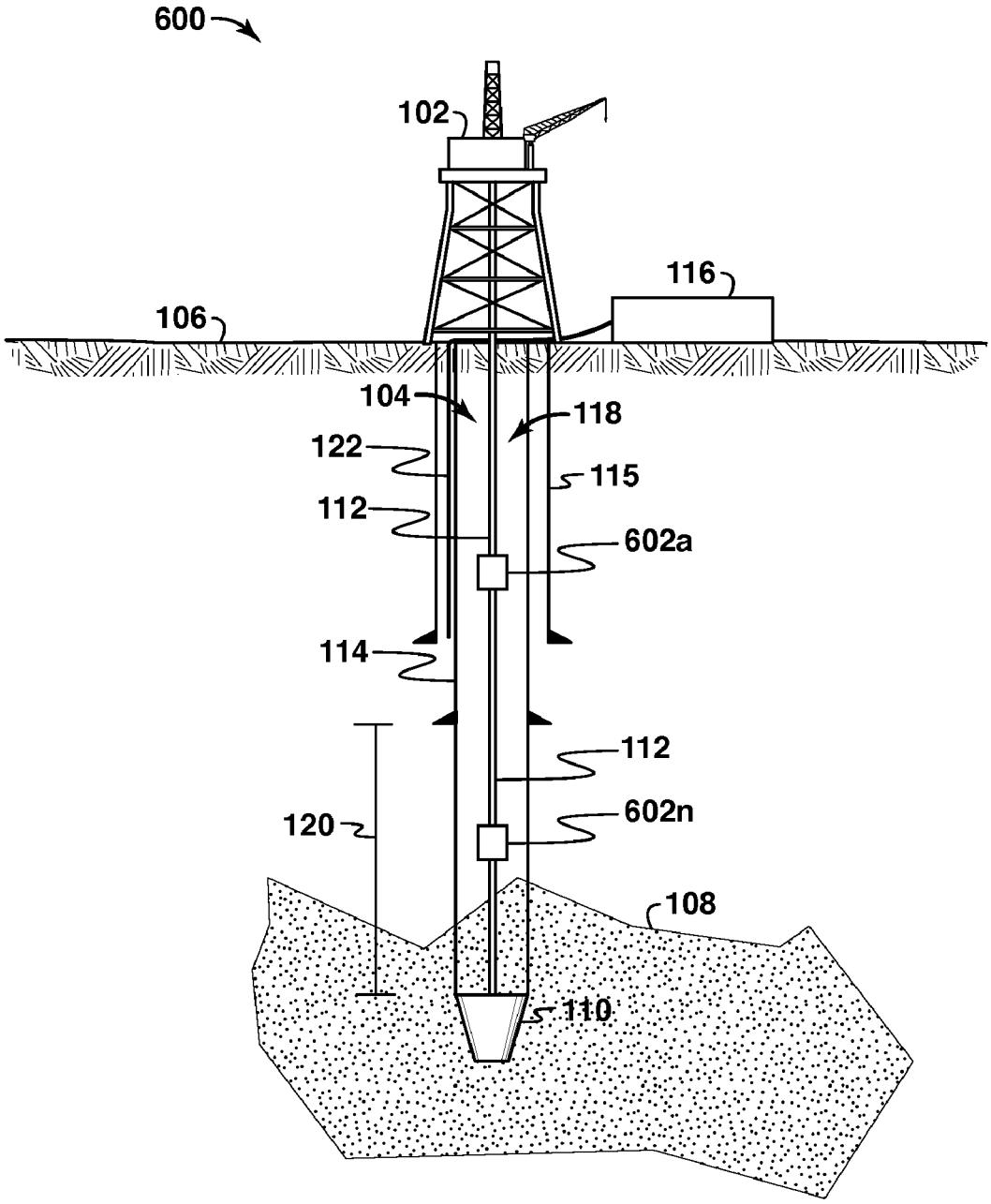
FIG. 6 is an illustration of an exemplary drilling system with downhole separators to manage the density of the wellbore annulus in accordance with certain aspects of the present techniques.

In addition, the downhole separators 500 and 520 may be utilized at various locations within the wellbore to further manage the density profile within the wellbore annulus. For example, as shown in FIG. 6, the drilling system 600 may include drilling components, such as bottom hole assembly (BHA) 110, drill pipe 112, casing strings 114 and 115, parasite strings 122, drilling mud processing unit 116 for processing the variable density drilling mud 118, downhole separators 602*a*-602*n*, and other systems to manage drilling and production operations. Because some of the components in the drilling system 600 are similar to the components of the drilling system 100, the same reference numerals are utilized. In this drilling system 600, the downhole separators 602*a*-602*n*, which may be embodiments of the downhole separators 500 and 520, may be coupled to the sections of drill pipe 112 to manage the density within the wellbore annulus. Also, it should be noted that the downhole separators 602*a*-602*n* may include any number of downhole separators, such as one, two, three or more, based on the desired density profile for the wellbore.

In the drilling system 600, the well 104 may penetrate the surface 106 of the Earth to reach the subsurface formation 108. The downhole separators 602*a*-602*n* may be placed within the well 104 at various places to control the density profile by removing a portion of the compressible particles the variable density drilling mud 118. The downhole separators 602*a*-602*n* may include any number of downhole separators, such as one, two, three or more, based on the desired density profile for the wellbore. A mixture of compressible particles having different densities may be used in the drilling process. Each separator is designed to separate a significant fraction of compressible particles, which may be adjusted based on the density designed for the wellbore, with a certain density from the flow inside the drill pipe and direct out of the drill pipe and into the wellbore annulus. For example, the drilling fluid may contain three types of compressible particles, which each having a different density profile versus pressure from the others. The lowest internal pressure compressible particles may be separated in the first separator and directed to the wellbore annulus because they have a higher density state. The higher internal pressure compressible particles may be separated at deeper locations in the drill pipe and directed to the wellbore annulus in other downhole separators. The highest internal pressure compressible particles may be separated in a downhole separator that is part of the BHA and directed to the wellbore annulus near the drill bit. As such, the downhole separators 602*a*-602*n* provide additional flexibility in managing the compressible particles and density profiles of the wellbore.

Also, it should be noted that the different methods and processes for removing the compressible particles may not remove all of the compressible particles, but may remove either a specific portion or a substantial amount of compressible particles. For instance, with the downhole separators, the separators may remove a substantial amount, such as 70%, of the compressible particles from the variable density drilling mud. The efficiency of the separations may be based on the downhole environment, downhole geometry and other factors, which may be specific to the application. As such, the various devices described above may remove at least a portion or all of the compressible particles, which may vary with different configurations.

Moreover, in other alternative embodiments, monitors may be used to further enhance the process. For example, as the well is drilled, the compressible particles are submitted to forces that may cause the compressible particles to rupture or fail resulting in a substantial loss of compressibility. Also, over time, the internal pressure of the compressible particles may decrease due to shell wall permeability. That is, while some compressible particles may maintain an internal pressure, others may lose internal pressure due to permeability through the wall of the compressible particles. These slightly damaged compressible particles may be recirculated because they have similar densities to other compressible particles that maintain their internal pressure. Thus, it becomes increasingly difficult to determine the wellbore density profile in the absence of downhole pressure while drilling (PWD) tools.

To enhance the operation of the system, monitors, such as mud density and pressure monitors, may be used to predict the downhole density profile. The calculation and prediction of the variable density drilling mud density (or pressure) profile within the wellbore may be beneficial to prevent exceeding the FG or going below the PPG, while drilling to a subsurface formation. Accurate methods for predicting the density profile of the variable density drilling mud are based on an understanding of the compressibility behavior of the components in the drilling fluid system. For example, the density profile at the initial stages of operations or for unused compressible particles may be predicted from modeling or experimental data and tests because the compressible particle's response to pressure is based on internal pressure and shell wall compression of the compressible particles. As such, modeling or experimental data may be used to provide the density profiles for different variable density drilling muds.

As the drilling operations progress, attrition of the high volume fraction of discrete compressible particles contained in the variable density drilling mud should be considered. That is, the attrition rate should be used in the calculation of bottom hole pressure with compressible drilling mud because it involves the integration of the variable mud density with depth from the surface to the bottom of the well. As a result, an accurate knowledge of the pressure-volume-temperature (PVT) characteristics of the variable density drilling mud may be useful to understand the compressible particle attrition rates. Accordingly, a method or mechanism is needed to measure the physical attrition rate along with any loss of internal particle pressure over time experienced by the distribution of compressible particles in the variable density drilling mud.

To provide this functionality, embodiments may continuously monitor the PVT characteristics of the variable density drilling mud in the wellbore. This can be accomplished by instrumenting the reciprocating mud pumps to continuously measure and record the piston displacement, the internal cylinder pressure as a function of piston displacement and the temperature of the mud in the cylinder during compression. In this manner, the PVT characteristics of the variable density drilling mud being injected into the wellbore is continuously available for the calculation of downhole density or pressure profile (particularly in the absence of PWD tools in the BHA). In addition, this data can be used to monitor the variable density drilling mud characteristics for the purpose of maintaining and/or changing the variable density drilling mud properties by addition or replacement of mud components, such as the compressible particles or drilling fluid, for example. The monitoring of these mud pumps, which may include mud pumps 408 and 426, for example, may provide additional data on the density to provide the proper density within the wellbore.

Accordingly, the use of the monitor may enhance drilling operations. For example, the monitors may determine the pressure volume temperature (PVT) characteristics of the variable density drilling mud. The PVT characteristics may be used to modify the volume of the compressible particles in the variable density drilling mud to provide a desired density and/or to modify the volume or density of the drilling fluid in the variable density drilling mud to provide a desired density. Further, PVT characteristics of the variable density drilling mud may be used to modify the volume of a first group of compressible particles having a first internal pressure and a second group of compressible particles having a second internal pressure to provide a desired density. That is, in other embodiments, the PVT characteristics may be used to allocate different volumes for compressible particles having different internal pressures to provide a specific density profile.

An alternative technique may be to have a compression device, which may operate continuously, to measure the PVT characteristics separate from the mud pumps. This compression device may take samples directly from the storage areas, such as mud pits 402 and 422 and/or storage vessel 432. In addition, there may be multiple devices measuring the PVT behavior or characteristics for the variable density drilling mud entering the drill string and the mud exiting the annulus of the wellbore.

Further still, the monitoring of the variable density drilling mud may also be beneficial in preventing and overcoming; kicks, in the event the variable density drilling fluid column pressure goes below the formation pore pressure, and fluid loss, in the event the variable density drilling fluid column pressure exceeds the formation fracture pressure. For example, a kick is often detected at the surface by mud pit volume gain while drilling and circulating the variable density drilling mud or annular flow after the mud pumps are turned off. When circulating frictional pressure is removed from the variable density drilling mud and the mud pumps are turned off, the compressible particles in the variable density drilling mud are expected to expand, and the variable density drilling mud in the wellbore annulus may flow out of the annulus. For a typical incompressible drilling mud, this may be perceived as evidence of taking a kick. Accordingly, understanding the density profile of the variable density drilling mud through surface measurements of PVT behavior may be beneficial in determining the difference between expansion of the compressible particles after the mud pumps are turned off and the taking of a kick.

If it is determined that a kick has been taken, common methods for overcoming the kick include the driller's method (e.g., two circulation process that removes kick with same density variable density drilling mud and then increases density of the variable density drilling mud that is circulated into the wellbore) and the weight and wait method (e.g., single circulation process that increases density of the variable density drilling mud while maintaining bottom hole pressure and circulates the kick out of the wellbore). In both methods, the bottom-hole pressure is maintained at a substantially constant level, while circulating the kick from the wellbore. Again, in the absence of a PWD tool in the drill string, it may be beneficial to have real-time or near real-time measurements of the density profile of the variable density drilling mud as a function of pressure. In this manner, the bottom hole pressures may be determined given the mud density profile and the surface pressures applied to the drill string or annulus during the kick circulation procedures.

While the present invention may be susceptible to various modifications and alternative forms, the exemplary embodiments discussed above have been shown only by way of example. The embodiments described above are not intended to include all possible configurations of the various separation equipment and techniques (e.g., shakers, hydrocyclones, settling tanks, centrifuges, and the like). It is envisioned that any of the separation techniques described above may be combined in such a way to achieve the desired separation of compressible particles from the variable density drilling mud or from other compressible particles by size and density. Again, it should be understood that the invention is not intended to be limited to the particular embodiments disclosed herein. Indeed, the present invention includes all alternatives, modifications, and equivalents falling within the true spirit and scope of the invention as defined by the following appended claims.

What is claimed is:

1. A system for drilling a wellbore comprising:

a wellbore;

a variable density drilling mud disposed in the wellbore, wherein the variable density drilling mud comprises compressible particles and drilling fluid;

drilling pipe disposed within the wellbore;

a bottom hole assembly coupled to the drilling pipe and disposed within the wellbore; and a drilling mud processing unit in fluid communication with the wellbore, wherein the drilling mud processing unit is configured to separate the compressible particles from the variable density drilling mud; and wherein the drilling mud processing unit comprises:

a rig shaker screen configured to receive the variable density drilling mud and cuttings from the wellbore and to divert material to a shaker flow path;

a cutting shaker screen coupled to the rig shaker screen and configured to receive the material from the shaker flow path and to divert material from the shaker flow path to a cutting flow path;

one of a hydrocyclone, a settling tank, and a centrifuge coupled to the cutting shaker screen and configured to receive material from the cutting flow path, separate material in the cutting flow path based on density, and provide material having a density similar to the compressible particles to an additional shaker screen; and the additional shaker screen configured to remove the compressible particles from the material having a density similar to the compressible particles.

2. The system of claim 1 wherein the rig shaker screen is configured to divert material equal to or greater than the size of the compressible particles; and wherein the cutting shaker screen is configured to divert material equal to or less than the size of compressible particles.

3. The system of claim 1 wherein the rig shaker screen is configured to divert material less than or equal to the size of the compressible particles; and wherein the cutting shaker screen is configured to divert material equal to or greater than the size of the compressible particles.

4. The system of claim 1 wherein the drilling mud processing unit is configured to remove damaged compressible particles from the variable density drilling mud.

5. The system of claim 1 wherein the compressible particles comprise compressible hollow objects filled with pressurized gas configured to maintain the mud weight between the fracture pressure gradient and the pore pressure gradient.

6. A system for drilling a wellbore comprising:

a wellbore;

a variable density drilling mud disposed in the wellbore, wherein the variable density drilling mud comprises compressible particles and drilling fluid;

drilling pipe disposed within the wellbore;

a bottom hole assembly coupled to the drilling pipe and disposed within the wellbore; and a drilling mud processing unit in fluid communication with the wellbore, wherein the drilling mud processing unit is configured to separate the compressible particles from the variable density drilling mud; and wherein the drilling mud processing unit comprises:

a rig shaker screen configured to receive the variable density drilling mud and cuttings from the wellbore and to divert material equal to or greater than the size of the compressible particles to a shaker flow path;

a cutting shaker screen coupled to the rig shaker screen and configured to receive the material from the shaker flow path and to divert material equal to or less than the size of the compressible particles from the shaker flow path to a cutting flow path;

a hydrocyclone coupled to the cutting shaker screen and configured to receive material from the cutting flow path, separate material in the cutting flow path based on density, and provide material having a density similar to the compressible particles to a hydrocyclone flow path; and an additional shaker screen coupled to the hydrocyclone and configured to receive material from the hydrocyclone flow path and remove the compressible particles from the hydrocyclone flow path.

7. A system for drilling a wellbore comprising:

a wellbore;

a variable density drilling mud disposed in the wellbore, wherein the variable density drilling mud comprises compressible particles and drilling fluid;

drilling pipe disposed within the wellbore;

a bottom hole assembly coupled to the drilling pipe and disposed within the wellbore; and a drilling mud processing unit in fluid communication with the wellbore, wherein the drilling mud processing unit is configured to separate the compressible particles from the variable density drilling mud; and wherein the drilling mud processing unit comprises:

a rig shaker screen configured to receive the variable density drilling mud and cuttings from the wellbore and to divert material less than or equal to the size of the compressible particles to a shaker flow path;

a cutting shaker screen coupled to the rig shaker screen and configured to receive the material from the shaker flow path and to divert material equal to or greater than the size of the compressible particles from the shaker flow path to a cutting flow path;

a hydrocyclone coupled to the cutting shaker screen and configured to receive material from the cutting flow path, separate material in the cutting flow path based on density, and provide material having a density similar to the compressible particles to a hydrocyclone flow path; and an additional shaker screen coupled to the hydrocyclone and configured to receive material from the hydrocyclone flow path and remove the compressible particles from the hydrocyclone flow path.

* * * * *